United States Patent [19]

Marino

[11] 4,027,351

[45] June 7, 1977

[54] BRUSH CONSTRUCTION

[75] Inventor: Frank Marino, Baldwin, N.Y.

[73] Assignee: The Wooster Brush Company, Wooster, Ohio

[22] Filed: Feb. 9, 1976

[21] Appl. No.: 656,531

[52] U.S. Cl. ..... 15/192

[51] Int. Cl.[2] ..... A46B 3/02

[58] Field of Search ..... 15/191–193, 15/159

[56] References Cited

UNITED STATES PATENTS

| | | | |
|---|---|---|---|
| 2,075,907 | 4/1937 | McMillan | 15/193 UX |
| 2,406,732 | 8/1946 | Hardman | 15/192 X |
| 2,508,799 | 5/1950 | Reis, Jr. | 15/159 A |
| 3,155,998 | 11/1964 | Hardman et al. | 15/192 |

FOREIGN PATENTS OR APPLICATIONS

| | | | |
|---|---|---|---|
| 116,356 | 12/1942 | Australia | 15/193 |
| 543,646 | 12/1955 | Belgium | 15/192 |
| 1,397,772 | 3/1965 | France | 15/193 |

*Primary Examiner*—Peter Feldman

*Attorney, Agent, or Firm*—Donnelly, Maky, Renner & Otto

[57] ABSTRACT

The ferrule of a bristle brush includes an annular bead peripherally about the ferrule proximate one end thereof, and the bead has a sufficiently large cross-sectional profile and circumscribes a volume having a sufficiently large cross-sectional area relative to the cross-sectional area of the volume circumscribed by the major tubular extent of the ferrule in order to permit expansion of that part of the bristle hold located in the volume circumscribed by the bead. A hardenable liquid adhesive material poured into the ferrule after the bristle is positioned therein will permeate appreciably into the hold of the bristle thereby substantially to encapsulate the same and to secure the filaments thereof tenaciously to the ferrule.

6 Claims, 5 Drawing Figures

BRUSH CONSTRUCTION

BACKGROUND OF THE INVENTION

The present invention relates, as indicated, to a brush construction and, more particularly, relates to an improved ferrule brush form that increases the tenacity with which the bristle is secured in the brush.

In a conventional bristle brush the bristle may comprise an assemblage of individual elongate bristle filaments, which may either be natural or synthetic filaments, fibers or the like. The bristle has a tip end for applying fluid-like material to a surface and a bottom or inner end, referred to as the butt end, secured in a generally tubular, longitudinally extending ferrule, for example, using epoxy or equivalent hardenable adhesive material. A handle or other holder also is usually connected to extend from the top of the ferrule for manipulating the brush. In the case of the bristle comprising an assemblage of parallel filaments, the respective butts or bottom extremities of the filaments are usually so closely packed in the ferrule as to form a substantially flat, almost solid surface area. The adhesive material later poured into the ferrule usually only penetrates the bristle for a distance of approximately one-eighth inch to one-fourth inch and bonds only with the bristle at that limited surface area.

To strengthen the ferrule, which is usually formed of sheet metal, plastic or other relatively thin material, one or more annular beads may be formed in the tubular wall of the ferrule extending peripherally thereabout generally perpendicularly with respect to the longitudinal extent of the ferrule. Such beads have had a relatively small semi-circular cross-sectional profile, which do not affect the close-packed compaction of the bristle hold end in the ferrule, and the bristle hold usually extends upwardly into the ferrule past at least one of the beads, for example, as in U.S. Pat. No. 3,155,998. In the brush structure disclosed in that patent the bristle hold preferably terminates between the two beads, and the epoxy resin flows into the upper bead and hardens therein to lock the hardened material in place in the ferrule. Also, the beads disclosed in that patent have relatively small cross-sectional profiles that would not provide for expansion of the bristle were the latter to terminate therein; nor would they permit the epoxy resin appreciably to flow into and about the bristle hold.

Since the individual elongate bristle filaments usually are tapered such that the butt end of each is appreciably larger in cross section than the tip end, and since a tubular ferrule normally will apply its shear holding force to the bristle filaments at the butt end or bottom extremities thereof where they are most closely packed, the bristle may assume a generally spreading or toe-out natural shape in a direction toward the filament tips. Such a toe-out shape is usually undesirable. Wood, cardboard or the like spacer inserts are usually placed between groups of filaments of the bristle at the butt end both to save material by reducing the required number of filaments to fill the ferrule opening area, to control the shape of the bristle reducing the flare or toe-out tendency thereof, and to provide a space inside the brush to act as a paint reservoir.

SUMMARY OF THE INVENTION

In the brush construction of the present invention, the longitudinally extending ferrule has a raised generally annular bead extending peripherally about the ferrule generally perpendicularly to the longitudinal axis thereof. The bead is formed in the generally tubular wall of the ferrule at a location between its opposite end portions, preferably more proximate the end portion from which the bristle extends, and the cross-sectional profile of the bead and its dimensional extent parallel to the longitudinal axis of the ferrule are sufficiently large to permit expansion of the bristle at its butt or inner end. The hardenable adhesive material poured into the ferrule, then, may permeate over a larger surface area of the bristle, as compared with the prior art constructions described above, and preferably permeates beyond the butt of the hold and into engagement with an appreciable extent of the sidewalls of the bristle filaments filling the remaining available volume circumscribed by the large annular bead. Upon hardening, the adhesive material tenaciously secures the bristle to the ferrule. Moreover, due to the permitted expansion of the bristle at its butt end, the ferrule skirt portion, which is generally tubular, is located between the bead and the bottom edge of the ferrule from which the bristle extends and circumscribes a volume of reduced cross section relative to that of the volume circumscribed by the bead whereby a shear force is applied to the bristle at that edge thereby to produce a natural toe-in of the bristle. In the preferred form of the invention, the ferrule bead has a generally rectangular cross-sectional profile, which further increases the strength of the ferrule relative to those using the prior art beads and, therefore, reduces the probability of encountering bellying or creasing during nailing of the brush handle or other holder means to the ferrule.

With the foregoing in mind, it is a primary object of the invention to provide a brush construction improved in the noted respects.

Another object of the invention is to increase the tenacity with which the bristle of a brush is secured in the ferrule thereof.

An additional object is to provide a natural toe-in tendency of the bristle of a brush.

A further object is to strengthen the ferrule of a brush.

These and other objects and advantages of the present invention will become more apparent as the following description proceeds.

To the accomplishment of the foregoing and related end, the invention, then, comprises the feature hereinafter fully described and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
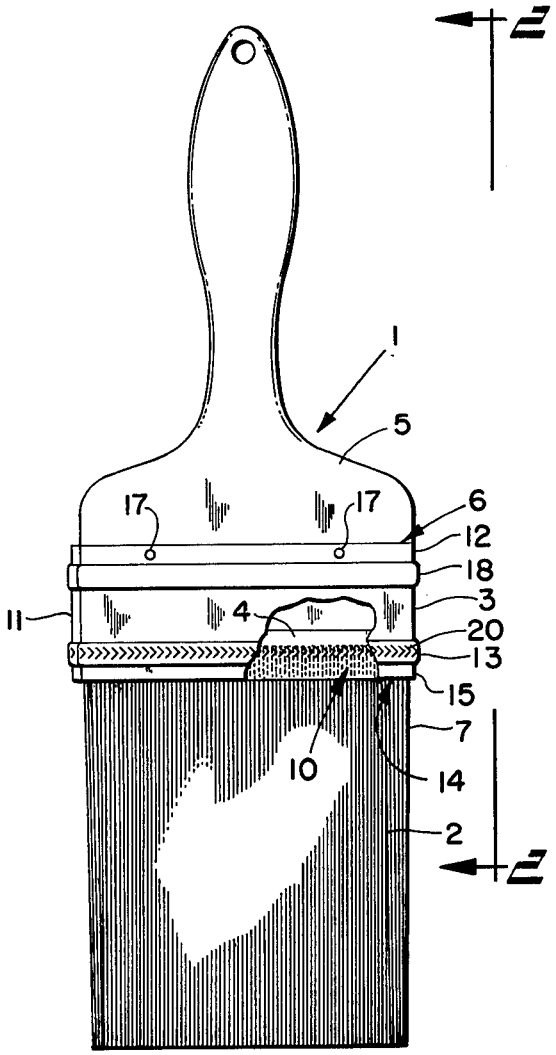
FIG. 1 is a front elevation view of the brush construction in accordance with the invention, partially broken away to show the extended penetration of the adhesive material securing the bristle to the ferrule.
Figure 2:
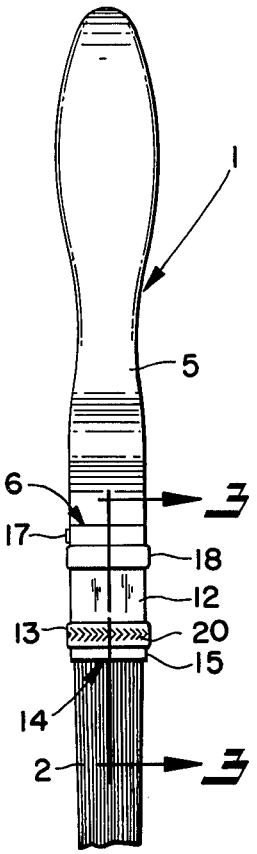
FIG. 2 is a partial side elevation view of the brush construction of FIG. 1; looking generally in the direction of the arrows 2—2 of FIG. 1.

Referring now more particularly to the drawing, wherein like reference numerals designate like parts in the several figures, and initially to FIGS. 1 and 2, a brush in accordance with the invention is generally indicated at 1. The brush 1 includes a bristle knot 2 connected to a ferrule 3 by a hardened block of adhesive material 4, and a handle 5 or other holder means for manipulation of the brush 1 is also coupled to the ferrule 3 through the open top end 6 thereof.

Figure 5:
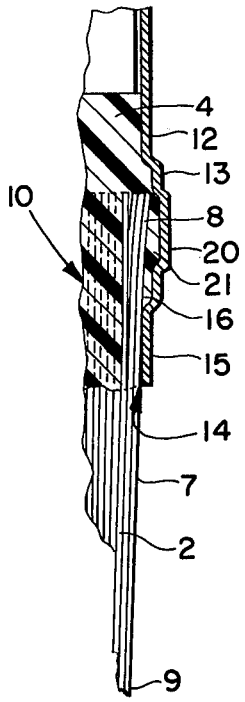
FIG. 5 is a further enlarged partial section view illustrating the expansion of the bristle filaments at their butt end in the enlarged volume afforded by the ferrule bead which results in a natural toe-in of the bristle.
Figure 3:
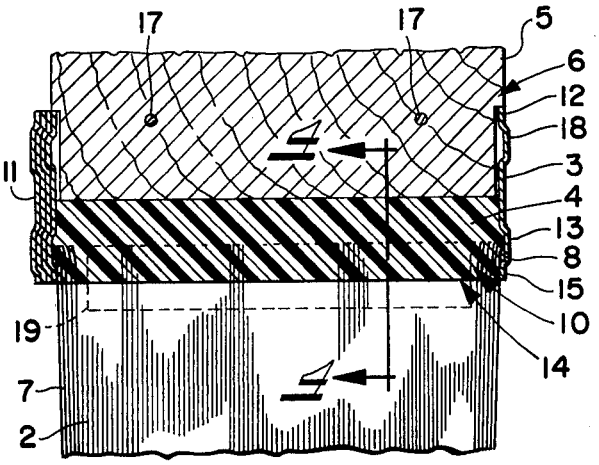
FIG. 3 is an enlarged partial section view looking in the direction of the arrows 3—3 of FIG. 2.
Figure 4:
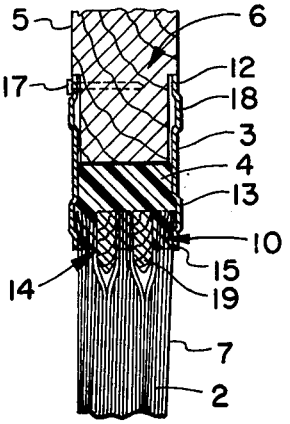
FIG. 4 is an enlarged partial section view looking generally in the direction of the arrows 4—4 of FIG. 3.

Turning now more particularly to FIGS. 3, 4 and 5, the bristle 2 is comprised of an assemblage of individual natural or synthetic bristle filaments 7, each of which is tapered from a relatively large cross section at its butt end portion 8 to a relatively narrower cross section at its top end portion or tip 9, as can be seen most clearly in FIG. 5; however, it is to be understood that the principles of the invention may be employed equivalently with other types of bristles, such as, for example, those formed of an assemblage of level fibers, and the like. The assemblage of the end portions 8 located within the ferrule 3 is known as the bristle hold 10.

The ferrule 3 may be formed of sheet metal material that is stamped, bent, and crimped closed, as at the juncture 11 of the formed tubular wall 12. The ferrule 3 may be equivalently formed of molded plastic or other suitably rigid and strong material.

A raised bead 13 is formed in the otherwise generally longitudinally extending tubular wall 12 of the ferrule 3 between the top end 6 and the open bottom end 14 thereof, and a tubular skirt portion 15 is located between the bead 13 and the end 14. The bead 13 is raised toward the exterior of the ferrule 3 relative to the major surface extent of the tubular wall 12, and the bead extends annularly about the peripheral circumference of the ferrule generally perpendicularly with respect to the longitudinal axis. Moreover, the dimensional extent of the bead 13 parallel to the longitudinal axis of the ferrule 3 and the width or raised extent of the annular bead above the major surface extent of the tubular wall 12, which includes the skirt portion 15, are sufficiently large so that the volume circumscribed thereby permits expansion of the bristle butts 8 located within such circumscribed volume. Preferably the annular bead 13 has a generally rectangular cross-sectional profile, which in addition to providing the expansion volume for the mentioned part of the bristle butts 8 at the top of the hold 10 also has been found to impart greater strength to the ferrule than the prior art semi-circular cross- sectional profile annular beads, and such enhanced ferrule strength has been effective to reduce or to eliminate the creasing or bowing problems previously encountered during nailing.

The tubular skirt portion 15, which may be generally co-parallel with the major surface extent of the tubular wall 12, circumscribes a volume that has a smaller cross section than that of the volume circumscribed by the annular bead 13. Therefore, after the knots of bristle filaments 7 have been inserted through the top end 6 of the ferrule to the relative positions shown in the drawing, the hold portion 10 of bristle filaments will be relatively closely-packed within the volume circumscribed by the skirt portion 15, and the latter will apply a shear force or pressure to the bristle knot 2 tending to urge the bristle filament tips 9 to assume an overall toed-in shape.

Preferably the bottom or inner extremities of the bristle filament butt end portions 8 are located longitudinally in the ferrule 3 approximately halfway between the lower-most and upper-most boundaries of the bead 13 or even further above that location, but, in any event, within the bead 13 below such upper-most boundary, so that the desired expansion of the butt ends 8 of the hold 10 will occur. Such expansion increases the effective porosity of the bristle at the butt ends so that upon pouring the hardenable liquid adhesive material 4 such as, for example, epoxy resin or the like, into the ferrule 3 from the top end 6 thereof, the liquid will permeate downwardly throughout the bristle hold 10. The quantity of liquid adhesive material 4 so poured into the ferrule 3 preferably is sufficient to provide for such permeation into the hold 10, to substantially fill the remaining available volume circumscribed by the bead 13 and not taken up by that part of the filaments located therewithin, and to fill a further volumetric portion of the ferrule 3 between the bead and the top end 6.

In accordance with the brush construction of the invention, for example, the bead 13 may have a dimension in the longitudinal direction of the ferrule 3 on the order of about one-fourth inch, and the skirt portion 15 may have a dimension in the same direction on the order of about one-eighth inch. The longitudinal extent of the bristle hold 10, then, may be on the order of from about ¼ to about 5/16 inch. Also, the internal depth of the bead 13 into the ferrule wall 12 in a direction perpendicular to the longitudinal extent of the ferrule 3 may be on the order of about 1/30 secondths inch. A brush thusly constructed, for example, will allow suitable expansion of at least part of the bristle knot located in the volume circumscribed by the bead 13 and, therefore, permits the liquid adhesive material to flow into an appreciable part of the hold to bond therewith.

Upon hardening, the adhesive material 4 bonds securely to the bristle filaments 7 at the butts thereof and over an appreciable length of the hold 10, thereby generally encapsulating the hold portion of a large number or even all of the bristle filaments 7, especially those bristle filaments located about the perimeter of the bristle knot. The bonded material 4 and bristle filaments 7 thus form a solid mass. Moreover, the hardened block of adhesive material 4, in addition to bonding with the interior wall of the ferrule 3 with which it is engaged, also becomes locked in place by the formed annular flange 16 thereof located directly within the annular bead 13.

The handle 5 may be inserted in the ferrule after the adhesive material 4 has hardened and may be coupled to the ferrule simply by one or more nails 17 or by other fastening techniques. An additional annular bead 18, of similar configuration and arrangement to the annular bead 13, may be formed in the tubular wall 12 near the upper end 6 of the ferrule further to strengthen the same and to reduce possible creasing and/or bowing during nailing. Moreover, although the handle 5 is illustrated as a typical brush handle, other equivalent holders may be coupled to the ferrule 3 for manipulation of the brush manually, by an automated painting machine, or the like.

One or more conventional spacer inserts, two of which are indicated at 19, may be placed in the bristle knot 2 at the butt end portion 8 thereof for the usual purposes to reduce the number of bristle filaments required to complete the bristle knot 2 and also to control the flare or shape of the bristle knot in order to reduce the tendency thereof to toe-out. The spacer inserts 19, which may be of wood, cardboard, metal, plastic or any other suitable material, preferably also bond with the adhesive material 4 becoming part of the integral structure therewith.

The annular bead 13 may, if desired, have a somewhat roughened surface-enlarging profile, such as, for example, in the form of a herringbone pattern, as is illustrated most clearly at 20 in FIGS. 1, 2 and 5. This surface enlarging pattern, which may be decorative, may also be employed further to increase the locking effect of the hardened block of material 4 in the ferrule 3. Accordingly, the pattern 20 defines discrete volumes 21 in the bead 13, as is shown in FIG. 5, and the poured liquid adhesive material 4 upon filling those discrete volumes will further lock the hardened material 4 itself to the ferrule and may additionally increase the encapsulation of the peripheral bristle filaments.

In view of the foregoing, it should now be clear that the brush in accordance with the invention provides for tenaciously securing the bristles thereof, reduces or eliminates creasing, bowing or the like during nailing, and has a controlled toe-in of the bristle.

The embodiments of the invention in which an exclusive property or privilege is claimed are defined as follows:

1. A brush, comprising:

bristle-like means for applying fluid-like material or the like to a surface, said bristle-like means having opposite end portions;

a longitudinally extending ferrule having a generally tubular wall extending substantially parallel to the longitudinal axis of said brush and terminating at opposite ends, a raised generally annular bead extending peripherally and circumferentially about said ferrule in said tubular wall at a location between said ends and generally perpendicularly to the longitudinal extent of said ferrule, said bead having a generally rectangular cross-sectional profile, one wall of said bead being generally parallel to the longitudinal extent of said ferrule, said ferrule including a generally tubular skirt portion between said bead and one of said ends thereof;

one end portion of said bristle-like means providing a hold which is positioned within the volume in said ferrule circumscribed at least in part by said skirt portion and part of said bead, the inner extremities of said hold terminating intermediate the longitudinal ends of said bead, and the remainder of said bristle-like means extending externally of said ferrule beyond said one end thereof, said bead having a sufficiently large cross-sectional profile and circumscribing a volume having a cross-sectional area sufficiently larger than the cross-sectional area of the volume circumscribed by said skirt portion to permit expansion of the part of said hold located within such larger cross-sectional area volume partially filling the volume of said bead thereby increasing the effective porosity of said bristle-like means at said hold to permit liquid adhesive means to more thoroughly permeate said hold; and hardenable adhesive means in said ferrule appreciably permeating into engagement with said hold and substantially filling the remaining available volume circumscribed by said bead for securing said bristle-like means to said ferrule, said hardenable adhesive means permeating between said hold and the interior wall of said bead to form an annular flange of hardened adhesive means within said annular bead to lock said hold in place.

2. A brush as set forth in claim 1 further comprising a raised pattern in said one wall of said bead, said raised pattern forming discrete volumes in said one wall of said bead, said adhesive means substantially filling the discrete volumes circumscribed by said raised pattern to increase the encapsulation of said hold and aid in locking said adhesive means to said ferrule.

3. A brush as set forth in claim 1 further comprising a further annular bead similar in configuration and orientation to said first-mentioned bead in said tubular wall of said ferrule relatively proximate the other of said ends thereof, and holder means secured to said ferrule at said other end thereof for manipulating the brush.

4. A brush as set forth in claim 1 wherein said bristle-like means comprises an assemblage of a plurality of tapered bristle filaments having a larger cross section at the hold end portion thereof and a smaller cross section at the opposite end portion thereof.

5. A brush as set forth in claim 4 wherein said skirt portion bears against at least part of said hold located within the volume circumscribed by said skirt portion to apply a shear force to said bristle filaments tending to cause said bristle filaments to assume a toe-in configuration.

6. A brush as set forth in claim 1 wherein said ferrule comprises sheet-like material, and spacer insert means are provided in said bristle-like means generally at said hold for controlling the shape of said bristle-like means.

* * * * *